United States Patent [19]

Cochran et al.

[11] Patent Number: 4,500,278

[45] Date of Patent: Feb. 19, 1985

[54] YARN HEAT TREATMENT APPARATUS

[75] Inventors: Stanley R. Cochran, Midlothian, Va.; Francis W. Strahorn, Hockessin, Del.

[73] Assignee: E. I. Du Pont de Nemours and Company, Wilmington, Del.

[21] Appl. No.: 487,897

[22] Filed: Apr. 22, 1983

[51] Int. Cl.[3] ..... B29C 25/00

[52] U.S. Cl. ..... 425/445; 264/346

[58] Field of Search ..... 264/346, 235.6, DIG. 73; 425/66, 404, 445

[56] References Cited

U.S. PATENT DOCUMENTS

| | | | |
|---|---|---|---|
| 2,807,863 | 10/1957 | Schenker | 264/235.6 |
| 3,150,435 | 9/1964 | McColm et al. | 264/346 |
| 3,739,056 | 6/1973 | Evans et al. | 264/346 |
| 3,767,756 | 10/1973 | Blades | 264/184 |
| 3,869,430 | 3/1975 | Blades | 528/348 |
| 4,111,628 | 9/1978 | Taylor | 425/445 |
| 4,112,668 | 9/1978 | Spiller | 264/235.6 |
| 4,298,565 | 11/1981 | Yang | 264/184 |

*Primary Examiner*—James Lowe

[57] ABSTRACT

Aromatic polyamide filaments are treated at high speed under tension by passage over an array of closely spaced, heated rolls at 175°-300° C., the filaments stretched 0-1.6% and passed over a second array of additional closely spaced, heated rolls at 175°-300° C., cooled and wound up.

2 Claims, 1 Drawing Figure

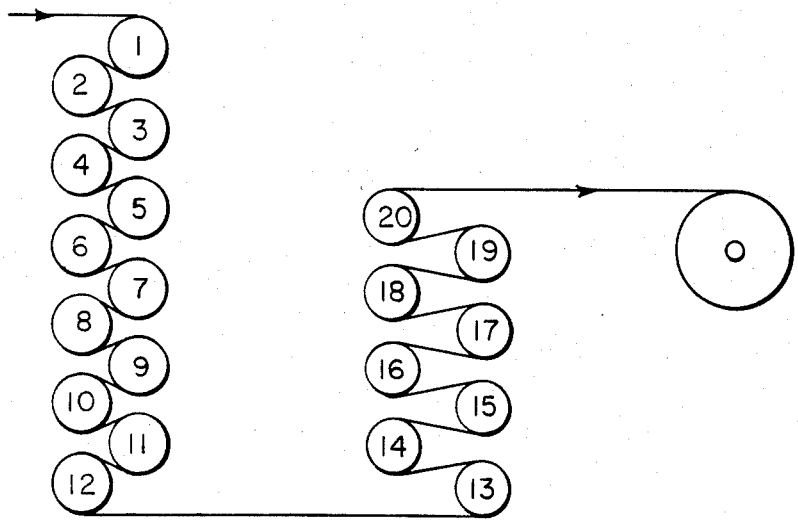
1
2
3
4
5
6
7
8
9
10
11
12
20
19
18
17
16
15
14
13
0

YARN HEAT TREATMENT APPARATUS

DESCRIPTION

Technical Field

This invention relates to an improved high speed process and compact apparatus for heat treating aromatic polyamide filaments derived from aromatic polyamides whose chain extending bonds are coaxial or parallel and oppositely directed. Such filaments are hereinafter referred to as para-aramid filaments.

BACKGROUND ART

U.S. Pat. No. 3,767,756 describes a process for spinning para-aramids to provide filaments having excellent as-spun tenacity, modulus and breaking elongation. This patent also discloses heat treatment of the as-spun fibers, preferably in an inert atmosphere, to provide filaments having a much higher modulus but lower breaking elongation. The tenacity usually decreases slightly from its already high value.

Of the para-aramids, poly(p-phenylene terephthalamide) (PPD-T) has achieved the greatest commercial success. U.S. Pat. No. 3,869,430 describes a heat treatment process for as-spun PPD-T filaments such as those prepared according to the process of U.S. Pat. No. 3,767,756 whereby the filaments are heated in a zone at a temperature of at least 150° C., preferably in an inert atmosphere, under a tension of at least 0.5 gpd (0.45 g/dtex) but less than the tension required to draw the filaments more than 1.03 times their initial length. The preferred temperature of the heating zone is 250°–600° C., most preferably 450°–580° C.

Although the prior art para-aramid heat treating processes teach that the heat treatment may be in an inert gas, or superheated steam or by a hot plate or infrared rays, hot pins, hot slots, hot rolls or liquid heating baths, only inert gas heat treatment has been demonstrated. However, hot gas treatment processes require either very long tubes for treatment or slow speed processing.

Since para-aramid filaments may be spun at spinning speeds greater than 457 m/min, it has not been practical to provide a coupled para-aramid spinning and heat treating process because even a one second heat treatment at 457 m/min requires a tube 7.6 m long.

This invention provides a process for heat treating para-aramid filaments at high speed under tension comprising the steps of (1) feeding para-aramid filaments having a filament tenacity of at least 18 gpd and a breaking elongation of at least 3.5% under a tension of 0.6 to 4.0 gpd to a first array of closely spaced heated rolls having a surface temperature of 175°–300° C., (2) passing the filaments over the rolls to provide at least 180° arc of contact with each roll, (3) stretching the filaments 0 to 1.6%, (4) passing the filaments over a second array of closely spaced heated rolls having a surface temperature of 175°–300° C. to provide at least 180° arc of contact with each roll, (5) cooling the filaments and collecting the filaments in a suitable package. Preferably the filaments are stretched 0.2 to 1.0% between the first and second arrays of heated rolls. Preferably the filaments are cooled by passing them over an array of cooled rolls to provide at least 180° arc of contact with each roll while maintaining 0.6 to 4.0 gpd tension on the entering filaments. Preferably the rolls are arranged in a staggered array to minimize machine size. The number of rolls in each array and their diameter must allow sufficient contact with the filaments that the required filament tension can be achieved. The total number of rolls must provide sufficient contact with the filaments to heat them to the desired temperature at the required process speed. Most preferably the first array of heated rolls consists of 5 induction heated rolls having a diameter of no more than 38 cm and the second array of heated rolls consists of 7 induction heated rolls having a diameter of no more than 38 cm. Most preferably the filaments are cooled by passing them back and forth in serpentine fashion over 8 cooled rolls having a diameter of no more than 30.5 cm to provide at least 180° contact with each roll while maintaining a tension of 0.6 to 4.0 gpd on the entering filaments. Most preferably the process is coupled directly with the spinning process.

This invention also provides a compact apparatus for heat treating a moving threadline comprising a first array of closely spaced heated rolls capable of operating at a surface speed in excess of 274 m/min and surface temperatures of 175°–300° C. followed by a second array of closely spaced heated rolls capable of operating at a surface speed in excess of the surface speed of the first array of rolls and having a surface temperature of 175°–300° C. and a third staggered array of closely spaced cooling rolls capable of operating at a surface speed that will maintain 0.6 to 4.0 gpd tension on yarn fed to the cooling rolls and followed by a device for collecting the filaments. Preferably the first array consists of 5 rolls having a diameter of no more than 38 cm, the second array consists of 7 rolls having a diameter of no more than 38 cm and the third array consists of 8 rolls having a diameter of no more than 30 cm.

BRIEF DESCRIPTION OF THE DRAWING

The drawing shows arrays of heating rolls (1–5 and 6–12) and cooling rolls (13–20) suitable for carrying out the invention.

DETAILED DESCRIPTION OF THE INVENTION

The starting fibers of the present invention are high strength, high modulus para-aramid filaments such as the as-spun filaments prepared according to the spinning process described in U.S. Pat. Nos. 3,767,756 and 4,298,565 having a tenacity of at least 18 gpd and a breaking elongation of at least 3.5%. The preferred fibers are poly(p-phenylene terephthalamide) (PPD-T) filaments.

The process of the present invention is preferably coupled with the spinning process and therefore is carried out at a speed commensurate with the spinning process which is preferably in the range of 350 to 1000 m/min. The filaments are preferably dried to a moisture content of 14±7% by weight before entering the heat treatment process. The filaments to be heat treated are fed into the process under a tension of 0.6 to 4.0 gpd and are passed back and forth in serpentine fashion over the first array of heated rolls allowing sufficient contact with the rolls to both heat the filaments to the approximate temperature of the rolls and prevent slippage from the tension applied by the following array of heated rolls.

The filaments are stretched 0–1.6%, preferably 0.2 to 1.0%, between the first and second arrays of heated rolls. The amount of stretch is determined by the excess of speed of the second array of heated rolls over the speed of the first array of heated rolls, which in turn determines the tension applied to the filaments. If desired the speed of the rolls can be controlled individually or each array can operate at the same speed.

The rolls in each array are conveniently heated separately by induction but may also be heated by other means such as high pressure steam or hot liquids. The rolls conveniently have the same diameter but rolls having different diameters may be used provided allowances are made for possible differences in surface speed.

The filaments are taken off the second array of heated rolls under a tension of 0.6 to 4.0 gpd. The filaments may be cooled in air prior to packaging but most preferably, the filaments are cooled by passing them over rolls maintained at a fixed lower temperature of 0°-100° C., preferably about 25° C. Uniform cooling increases the uniformity of the product filaments.

The product filaments may be packaged in any desired way such as for example winding on a bobbin. A finish or water may be conveniently applied to the filaments before packaging.

In the FIGURE, continuous filament yarn Y is passed back and forth in serpentine fashion over a first array of heated rolls 1-5, the yarn is stretched 0-1.6% and passed to a second array of heated rolls 6-12. The heat treated yarn may be cooled in air and then wound up but is preferably cooled by passage back and forth in serpentine fashion over cooled rools 13-20 and then wound up.

TESTS

Yarn tensile properties are measured at 25° C. and 55% relative humidity on yarns which have been conditioned under the test conditions for a minimum of 14 hours. Before testing, each yarn is twisted to a 1.1 twist multiplier (e.g., nominal 1500 denier [1670 dtex] yarn is given a twist of about 0.8 turns/cm). Tenacity is measured on a 25.4 cm length of yarn at 10% strain/minute. Linear densities are calculated from the weight of a known length of yarn after drying at 135°-140° C. for 30 min. Conditioned yarn increases in linear density by 4 to 4.5%.

The twist multiplier (TM) correlates twist per unit of length with the linear density of the yarn being twisted. It is computed from $$TM = \frac{(\text{denier})^{\frac{1}{2}}\,(tpi)}{73}$$

where tpi = turns per inch $$TM = \frac{(\text{dtex})^{\frac{1}{2}}\,(tpc)}{30.3}$$

where tpc = turns per centimeter

Moisture content is measured by weighing a yarn sample before and after drying for 30 minutes in an oven at 135°-140° C.

$$\%\ \text{moisture} = \frac{\text{weight before drying minus weight after drying} \times 100}{\text{weight after drying}}$$

Orientation angle is measured as in U.S. Pat. No. 3,869,430 Column 6, lines 14 to Column 17, line 27.

Apparent Crystalline size is measured as in U.S. Pat. No. 3,869,430 Column 7, line 30 to Column 8, line 59.

SPINNING PROCESS

In the following examples, filaments of poly(p-phenylene terephthalamide) are prepared substantially as described in U.S. Pat. No. 4,298,565. The jet employed is substantially that described as Jet E with a 2.5 in (6.35 cm) extension of the spin tube and a jet width of 12 mils (0.30 mm).

The heat treatment process is coupled to the spinning process.

EXAMPLE 1

A yarn bundle of 768 filaments is led under a tension of 2.4 gpd to a staggered array of 5 closely spaced induction heated rolls having diameters of 24.77 cm, temperatures of 250°, 255°, 260°, 265° and 270° C., respectively, and common peripheral velocity of 460.97 m/min. The filaments are passed back and forth in serpentine fashion to provide about 235° contact with each roll. Then the filaments are passed to a staggered array of 7 closely spaced induction heated rolls having diameters of 24.77 cm, temperatures of 275°, 280°, 285°, 290°, 290°, 290° and 290° C., respectively, and a common peripheral velocity of 463.39 m/min. The filaments are passed back and forth in serpentine fashion to provide about 235° contact with each roll. The time of contact with roll surfaces during passage of a section of the filaments over the 12 heated rolls is 0.76 seconds. The difference in speed of the two sets of heated rolls causes 0.52% stretch. The filaments are then passed under a tension of 3.5 gpd to a staggered array of 8 closely spaced cooling rolls having a diameter of 20.32 cm, a common temperature of 25° C. and peripheral velocity of 463.84 m/min. The filaments are passed back and forth in serpentine fashion over the cooling rolls to provide about 200° contact with each roll. A finish (1.02%) is applied to the filaments and the filaments are wound on a bobbin. Average properties of the continuous filament yarn are tenacity/elongation/modulus/denier = 24.4 gpd/2.4%/884 gpd/1092. The orientation angle of the filaments is 10.6° and the apparent crystallite size (ACS) is 72.0 Å.

EXAMPLE 2

A yarn bundle of 267 filaments is led under a tension of 1.2 gpd to a staggered array of 5 closely spaced induction heated rolls having diameters of 24.77 cm, temperatures of 260°, 260°, 260°, 260° and 275° C., respectively, and peripheral velocity of 366.83 m/min. The filaments are passed back and forth in serpentine fashion to provide about 235° contact with each roll. The filaments are then passed to a staggered array of 7 closely spaced induction heated rolls having diameters of 24.77 cm, temperatures of 275°, 275°, 275°, 290°, 290° and 290° C., respectively, and peripheral velocity of 370.57 m/min. The filaments are passed back and forth in serpentine fashion to provide about 235° contact with each roll. The time of contact with roll surfaces during passage of a section of the filaments over the 12 heated rolls is 0.96 seconds. A 1% stretch occurred between the two sets of rolls. The filaments are then passed under a tension of 3.0 gpd to a staggered array of 8 closely spaced cooling rolls having a diameter of 20.32 cm, a temperature of 25° C. and peripheral velocity of 370.57 m/min. The filaments are passed back and forth in serpentine fashion over the cooling rolls to provide about 200° contact with each roll. A finish is applied (0.97% on yarn) and the continuous filament yarn is wound on a bobbin. Average properties of the yarn are tenacity/elongation/modulus/denier=24.4 gpd/2.41%/945 gpd/375. The orientation angle of the fibers is 8.5° and the apparent crystalline size (ACS) is 73 Å.

EXAMPLE 3

A yarn bundle of 1000 filaments is led under a tension of 2.1 gpd to a staggered array of 5 closely spaced induction heated rolls having diameters of 24.77 cm, temperatures of 260°, 260°, 260°, 260°, and 270° C., respectively, and a common peripheral velocity of 690.96 m/min. The filaments are passed back and forth in serpentine fashion to provide about 235° arc of contact with each roll. Then the filaments are passed to a staggered array of 7 closely spaced induction heated rolls having diameters of 24.77 cm, temperatures of 270°, 270°, 280°, 280°, 280° and 280° C., respectively, and a common peripheral velocity of 694.38 m/min. The fibers are passed back and forth in serpentine fashion to provide about 235° arc of contact with each roll. The time of contact with roll surfaces during passage of a section of the filaments over the 12 heated rolls is 0.51 seconds. The difference in speed of the two sets of heated rolls causes 0.50% stretch. The filaments are then passed under a tension of 3.0 gpd to a staggered array of 8 closely spaced cooling rolls having a diameter of 20.32 cm, a temperature of 25° C. and a common peripheral velocity of 694.80 m/min. The filaments are passed back and forth in serpentine fashion over the cooling rolls to provide about 200° contact with each roll. A finish (0.88%) is applied to the yarn and the continuous filament yarn is wound on a bobbin. Average properties of the yarn are tenacity/elongation/modulus=22.4 gpd/2.40%/845 gpd. The orientation angle of the fibers is 12.0°, and the apparent crystalline size (ACS) is 67.8 Å.

What is claimed is:

1. Apparatus for heat treating para-aramid filaments at high speed comprising a staggered array of at least 3 closely spaced heated rolls having diameters of no more than 38.1 cm capable of operating at a first surface speed in excess of 274 m/min and surface temperatures of 175°-300° C. followed by a second staggered array of at least 3 closely spaced heated rolls having diameters of no more than 38.1 cm capable of operating at a surface speed in excess of the surface speed of the first array of rolls and having surface temperatures of 175°-300° C. and a third staggered array of at least 3 closely spaced constant-temperature cooling rolls having diameters of less than 30.5 cm capable of operating at a surface speed sufficient to maintain 0.6 to 4.0 gpd tension on yarn entering the cooling rolls.

2. Apparatus of claim 1 wherein the first array consists of 5 rolls, the second array consists of 7 rolls and the third array consists of 8 rolls.

* * * * *